US006577053B1

(12) United States Patent
Azzi et al.

(10) Patent No.: US 6,577,053 B1
(45) Date of Patent: Jun. 10, 2003

(54) DEFLECTION COIL HAVING A WINDING WINDOW

(75) Inventors: Nacerdine Azzi, Fontaine les Dijon (FR); Sebastien Volatier, Dijon (FR); Olivier Masson, Dijon (FR)

(73) Assignee: Thomson Licensing S.A., Boulogne Cedex (FR)

( * ) Notice: Subject to any disclaimer, the term of this patent is extended or adjusted under 35 U.S.C. 154(b) by 224 days.

(21) Appl. No.: 09/641,602

(22) Filed: Aug. 18, 2000

(30) Foreign Application Priority Data

Aug. 30, 1999 (FR) ..... 99 10897

(51) Int. Cl.[7] ..... H01J 9/236
(52) U.S. Cl. ..... 313/433; 313/213; 335/216
(58) Field of Search ..... 313/433, 76; 335/213, 335/210, 340

(56) References Cited

U.S. PATENT DOCUMENTS

| | | | |
|---|---|---|---|
| 2,562,395 | A | 7/1951 | Schlesinger |
| 3,731,241 | A | 5/1973 | Coupland |
| 4,039,988 | A | 8/1977 | van der Heijde |

FOREIGN PATENT DOCUMENTS

| | | |
|---|---|---|
| EP | 0366196 | 5/1990 |
| FR | 90 6905 | 5/1973 |
| FR | 2757678 | 6/1998 |
| FR | 2757681 | 6/1998 |

OTHER PUBLICATIONS

Copy of Search Report.

*Primary Examiner*—Vip Patel
*Assistant Examiner*—Ken A Berck
(74) *Attorney, Agent, or Firm*—Joseph S. Tripoli; Harvey D. Fried; Sammy S. Henig

(57) ABSTRACT

Electromagnetic deflection unit for colour cathode-ray tubes, comprising a pair of horizontal deflection coils and a pair of vertical deflection coils, the saddle-shaped vertical deflection coils having a rear bundle on the electron-gun side and a front bundle located on the screen side, lateral conductor harnesses 120 connecting the two bundles so as to produce a main window in the intermediate region lying between these said bundles, the conductor harnesses being arranged so that, at the front end of the main window 18, on the screen side, the window 18 extends over a radial angular aperture Φ of greater than 38°.

This arrangement of the conductors in the rear part of the window makes it possible to minimize the vertical convergence errors between the red and blue beams, so as to avoid the use of additional field shapers to correct the said errors.

4 Claims, 4 Drawing Sheets

DEFLECTION COIL HAVING A WINDING WINDOW

The invention relates to a deflection unit for colour cathode-ray tubes, which unit is also called a deflector and comprises a pair of horizontal deflection coils and a pair of vertical deflection coils in the form of a saddle whose particular shape allows the convergence errors to be minimized.

A cathode-ray tube designed to generate colour images generally comprises an electron gun emitting three coplanar electron beams, each beam being intended to excite bands of luminescent material of the corresponding colour (red, green or blue) on the tube's screen.

The electron beams scan the tube's screen under the influence of the deflection fields created by the horizontal and vertical deflection coils of the deflector which is fixed to the neck of the tube. A ring of ferromagnetic material conventionally surrounds the deflection coils so as to concentrate the deflection fields in the appropriate region.

The three beams generated by the electron gun must always converge on the tube's screen or else suffer the introduction of a so-called convergence error which, in particular, falsifies the rendition of the colours. In order to achieve convergence of the three coplanar beams, it is known to use so-called self-converging astigmatic deflection fields; in a self-converging deflection coil, the intensity of the horizontal-deflection field then has a pincushion-shaped distribution and that of the vertical deflection field has a barrel-shaped distribution.

Coma is an aberration which affects the side beams coming from an electron gun having three beams in line, independently of the astigmatism of the deflection fields and of the curvature of the screen surface of the tube; these side beams enter the deflection region at a small angle with respect to the axis of the tube and undergo a deflection in addition to that of the axial beam. The coma is generally corrected by modifying the distribution of the deflection fields at the point where the beam enters the deflector so that the coma generated compensates for that produced by the field distribution necessary to obtain the desired astigmatism for self-convergence. Thus, with regard to the horizontal deflection field, the field at the rear of the deflector has the shape of a barrel and in the front part has the shape of a pincushion.

Field configurations like those described above may cause the appearance of errors in the convergence of the side electron beams, which are manifested on a rectangular test pattern displayed on the tube's screen by a shift in the red image with respect to the blue image along the vertical edge of the test pattern. If the shift varies in a linear manner, it is possible, in a known way, to remedy it; on the other hand, if the value of the red/blue convergence error does not vary in a linear manner along the vertical edge of the test pattern, there was not hitherto a means for remedying this phenomenon, called "vertical blue wave", in a simple manner.

Moreover, the problems of geometry of the image formed on the tube's screen, of coma and of convergence are associated with the planarity of the screen and with the size of the latter. Conventional cathode-ray tubes manufactured a few years ago and using a screen of spherical shape generally have a small radius of curvature. Since the current trend is moving towards screens of large radius of curvature, or else completely flat screens, with diagonals greater than 70 cm in length, it is becoming increasingly difficult to control the abovementioned problems solely by means of suitable fields generated by the deflection coils.

It is common practice to divide the deflection system into three successive action regions along the main axis of the tube: the rear region closest to the electron gun influences more particularly the coma, the intermediate region acts more particularly on the astigmatism of the deflection field and therefore on the convergence of the red and blue electron beams and, finally, the front region, lying closest to the tube's screen, acts on the geometry of the image which will be formed on the tube's screen.

The invention aims to provide a solution to the "vertical blue wave" problem without adding additional components such as metal pieces arranged so as to locally modify the fields of the permanent magnet or magnets, which solution provides a means of additional control without moreover impairing the other characteristics of the deflection device, the correction of one characteristic generally causing degradation of one or more others.

To do this, the electromagnetic deflection unit for colour cathode-ray tubes according to the invention comprises a pair of horizontal deflection coils and a pair of vertical deflection coils, the vertical deflection coils being in the shape of a saddle and comprising a front bundle lying on the screen side of the tube and a rear bundle lying on the electron-gun side, the said bundles being connected together by lateral conductor harnesses, the front and rear bundles and the lateral harnesses defining a window free of conductors, which deflection unit is characterized in that, in the region close to the front bundle, the window extends over a radial angular aperture $\Phi$ of greater than 38°.

Other features and advantages of the invention will appear from the description below and from the drawings among which:

FIG. 4 illustrates an embodiment of a vertical deflection coil according to the invention shown face on.

Figure 1:
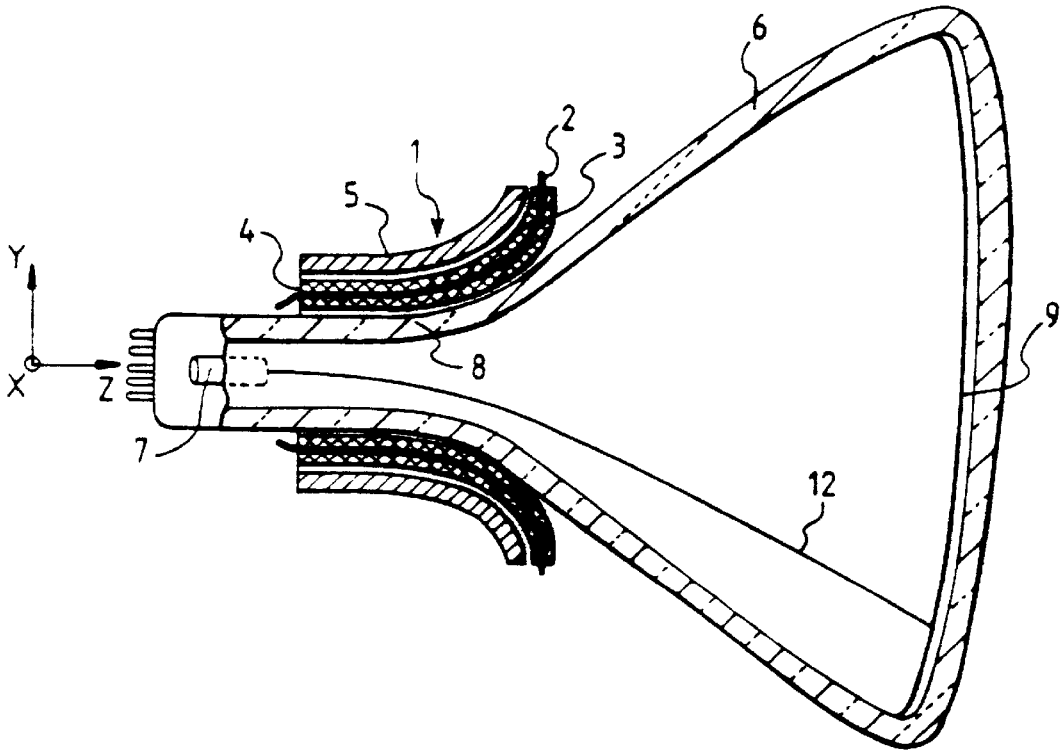
FIG. 1 shows a cathode-ray tube equipped with a deflector according to the invention.

As illustrated in FIG. 1, a self-converging colour display device comprises a cathode-ray tube fitted with an evacuated glass envelope 6 and an array of phosphors representing various colours, these phosphors being arranged at one of the ends of the envelope, forming a display screen 9, and a set of electron guns 7 arranged at a second end of the envelope. The set of electron guns is arranged so as to produce three electron beams 12 aligned horizontally so as to excite, respectively, one of the-various colour phosphors. The electron beams scan the entire surface of the screen by means of a deflection system 1, or deflector, which is placed on the neck 8 of the tube and comprises a pair of horizontal deflection coils 3, a pair of vertical deflection coils 4, these being isolated from each other by a separator 2, and a core 5 made of ferromagnetic material intended to concentrate the field at the point where it is designed to act.

Within the scope of the invention, each vertical deflection coil of the deflector 1 is in the shape of a saddle and has a portion 19 called a rear end bundle, close to the electron gun 7 and preferably extending in a direction parallel to the Z axis. A second portion 29, called the front end-bundle, of the coil 10 is close to the display screen 9 and is incurvate, on moving away from the Z axis, in a direction generally transverse to the latter. The front end bundle 29 of the saddle-shaped coil 4 is connected to the rear end bundle 19 by groups of lateral conductors 120. The bundles 19 and 29 as well as the lateral groups of conductors 120, generally arranged symmetrically with respect to an XZ plane, define a main window 18. Taking as reference the direction of flow of the electrons making up the three beams coming from the gun 7, the region over which the window 18 extends is called the intermediate region 24, the region over which the conductors making up the front bundle fan out is called the exit region 23 and that region of the coil which lies to the rear of the window 18 making up the rear bundle is called the entry region 25.

Figure 2:
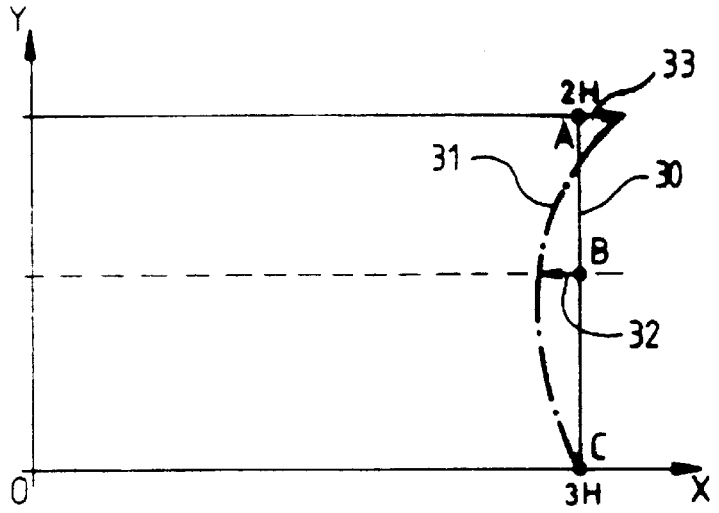
FIG. 2 shows diagrammatically a quarter of a colour cathode-ray tube screen on which the so-called "vertical blue wave" aberrations may be seen.

FIG. 2 illustrates a "vertical blue wave" aberration that the present invention aims to minimize. A test pattern is displayed on one quarter of the screen and illustrates the shift of the images created by the red beam 30 and the blue beam 31. To a first approximation, the "vertical blue wave" is determined by means of the equation:

$$VBW=(\Delta C+\Delta A)/2-\Delta B,$$

where ΔA is the red/blue convergence error at 3 o'clock, ΔC is the convergence error at 2 o'clock and ΔB is the convergence error at the half hour between 2 o'clock and 3 o'clock.

Figure 3:
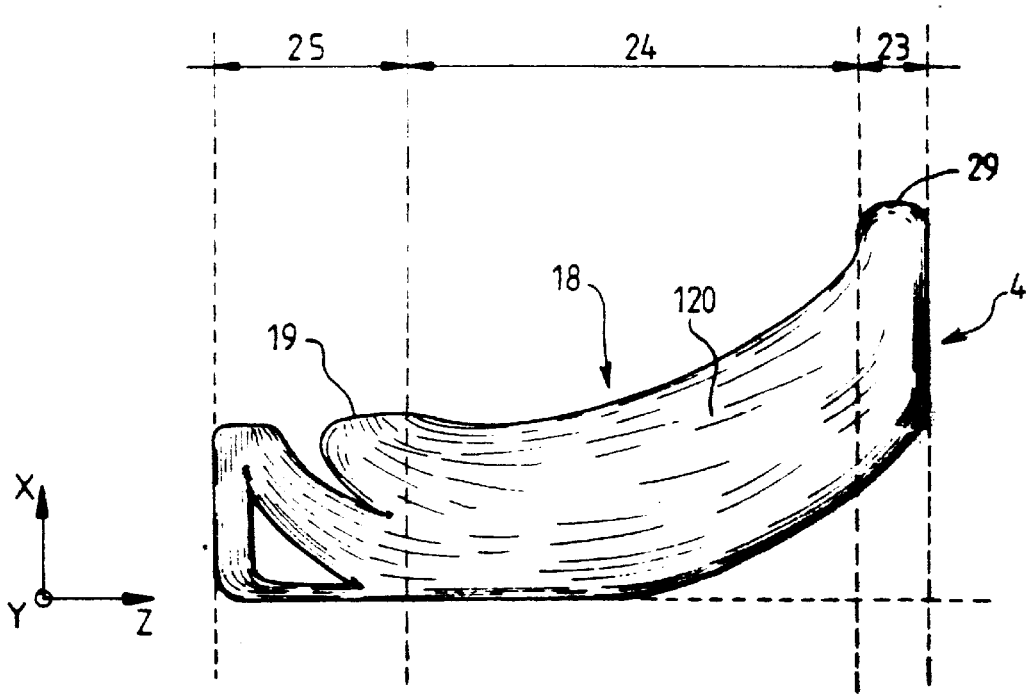
FIG. 3 is a side view of a coil according to the invention.

FIG. 3 illustrates, by means of a side view, one of the pairs of the saddle-shaped coils 4 implementing one aspect of the invention. Each winding turn is formed by a loop of conductor wire generally having the shape of a saddle.

A saddle-shaped coil as described above and shown in FIG. 4 may be wound with a fine copper wire, the wire being covered with an electrical insulation and with a thermosetting adhesive. The winding is carried out in a winder which winds the saddle-shaped coil essentially in its final shape and which introduces spaces 21, 21', 21", etc. during the winding process. The shapes and the locations of these spaces are defined by retractable pins 22 or by inserts 28. After winding, each saddle-shaped coil is held in place in a jig and pressure applied to it so as to obtain the required mechanical dimensions. A current passes through the wire so as to soften the thermosetting resin, which is then cooled so as to bond the wires together and to form a self-supporting saddle-shaped coil.

Because of the symmetries of the windings, the ampere-turns density N(θ) of a coil may be expanded as a Fourier series:

$$N(\theta)=\Sigma A_K.\cos(K\theta),\ \text{for } K=1, 3, 5, 7, \text{etc.},$$

$$\text{with } A_K=(4/\pi).\int_0^{\pi/2}N(\theta).\cos(K\theta).d\theta,$$

where $A_K$ are the winding harmonics. The potential may be expressed as the sum of the ampere-turns from the axis as far as Θ, i.e.:

$$\Phi(R,\Theta)=\int i.N(\theta).d\theta$$

The scalar potential at a point M in coordinates R, θ may be written as:

$$\Phi(R,\Theta)=\Sigma\Phi_K(R).\sin(K.\Theta),\ \text{for } K=1, 3, 5, 7, \text{etc.},$$

where R is the radius of the ferrite magnetic circuit which covers the deflection coils so as to concentrate the fields in order to improve the energy efficiency of the deflection device.

The harmonic of order K has as amplitude:

$$\Phi_K(R)=(A_K/K).$$

The self-converging deflectors have vertical deflection fields whose intensity has a barrel-shaped distribution. Moreover, it is known that the convergence errors between the red and blue beams are corrected in the intermediate region 24 of the vertical deflection coils by varying the position of the conductors of the lateral harnesses in order to modify the potential harmonics of order 3 and/or 5. These considerations have hitherto made it possible to design vertical deflection coils with as narrow as possible a main window, which design is particularly suited when the "vertical blue wave" is equal or close to zero; however, this coil structure does not provide a solution if the red/blue convergence errors vary in a non-linear manner along the vertical edge of the image between the 2 o'clock and 3 o'clock points.

The invention resides in the modification of the $7^{th}$ and $9^{th}$ potential harmonics in the front region of the main window 18, near the exit region 23. By varying the arrangement of the conductors making up the lateral harnesses 120 in this front region of the main window, it is possible to modify only the red/blue convergence in order to eliminate the "vertical blue wave" phenomena.

Figure 4:
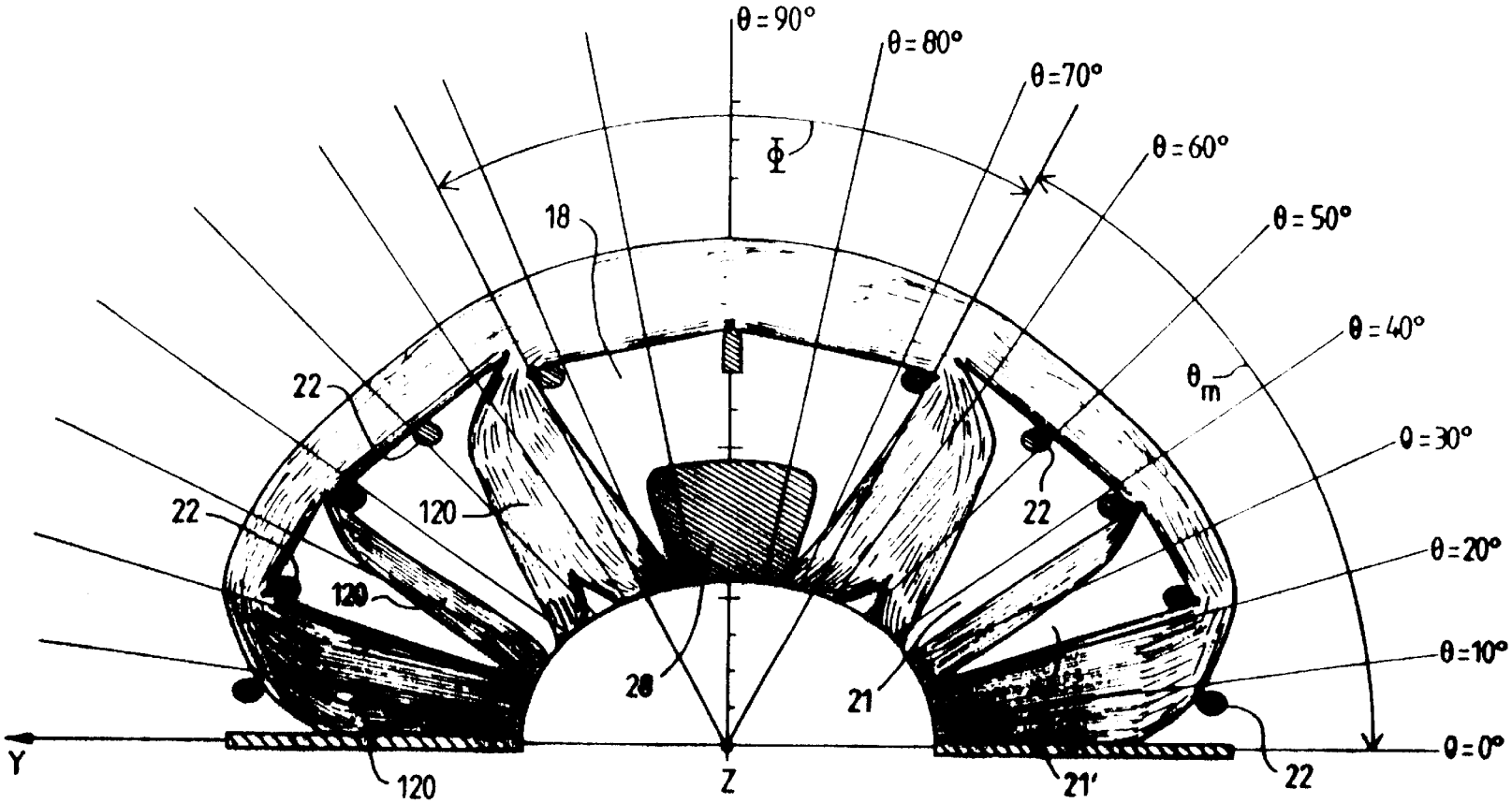

FIG. 4 illustrates one embodiment of the invention in which the vertical deflection coil is shown front on.

The front of the main window 18 of the vertical deflection coil is therefore enlarged with respect to the prior art so that, near the transition region between the parts 23 and 24 of the coil, at least 98% of the conductors of the lateral harnesses lie within a radial angular aperture $\Theta_m$ of less than 71°, $\Theta_m$ being measured with respect to the plane of separation, YZ, of the two vertical deflection coils.

In the case of large-sized tubes having a screen diagonal of greater than 70 cm, experience shows that $\Theta_m$ is preferably chosen within a range lying between 60° and 71°, which is equivalent to saying that in the region close to the front bundle, the window (18) extends over a radial angular aperture Φ of between 38° and 60°.

For example, for a tube of 97 cm diagonal and of 16/9 screen format, the vertical deflection coil of which is according to FIG. 4, the conductors of the lateral harnesses lie, at the front of the main window 18, within a radial angular aperture $\Theta_m$ of 67.5°.

In order to control other parameters, either the convergence or the geometry of the image formed on the screen, the main window may contain, in its front part, a small fraction of lateral conductors without thereby affecting the red/blue convergence characteristics along the vertical edge of the image. To do this, the number of turns lying within the main window 18 must be small, at most about 2% of the number of turns making up the coil.

The tables below compare the measurements, with respect to one quarter of the screen, obtained with a deflector fitted with vertical deflection coils according to the state of the art, that is to say having an arrangement of lateral conductors such that, in the region close to the front bundle, the main window 18 extends over a radial angular aperture Φ of 37°, and a deflector fitted with vertical deflection coils according to the invention, this being for the abovementioned tube with a 97 cm diagonal.

| Vertical coils according to the state of the art (the red/blue convergence error is expressed in mm): | | | Vertical coils modified according to the invention | | |
|---|---|---|---|---|---|
| 12 o'clock | | 2 o'clock | 12 o'clock | | 2 o'clock |
| 0.01 | 0.63 | 0.26 | 0.14 | 0.34 | 0.16 |
| 0.00 | −0.06 | −1.03 | 0.02 | −0.04 | −0.54 |
| 0.00 | 0.00 | 0.00 | 0.00 | 0.00 | 0.00 |
| | | 3 o'clock | | | 3 o'clock |

It may be seen that the value of the "vertical blue wave" error has been greatly reduced, going from 1.16 mm to 0.62 mm. This correction was made without altering the coma or the geometry of the image.

Figure 5:
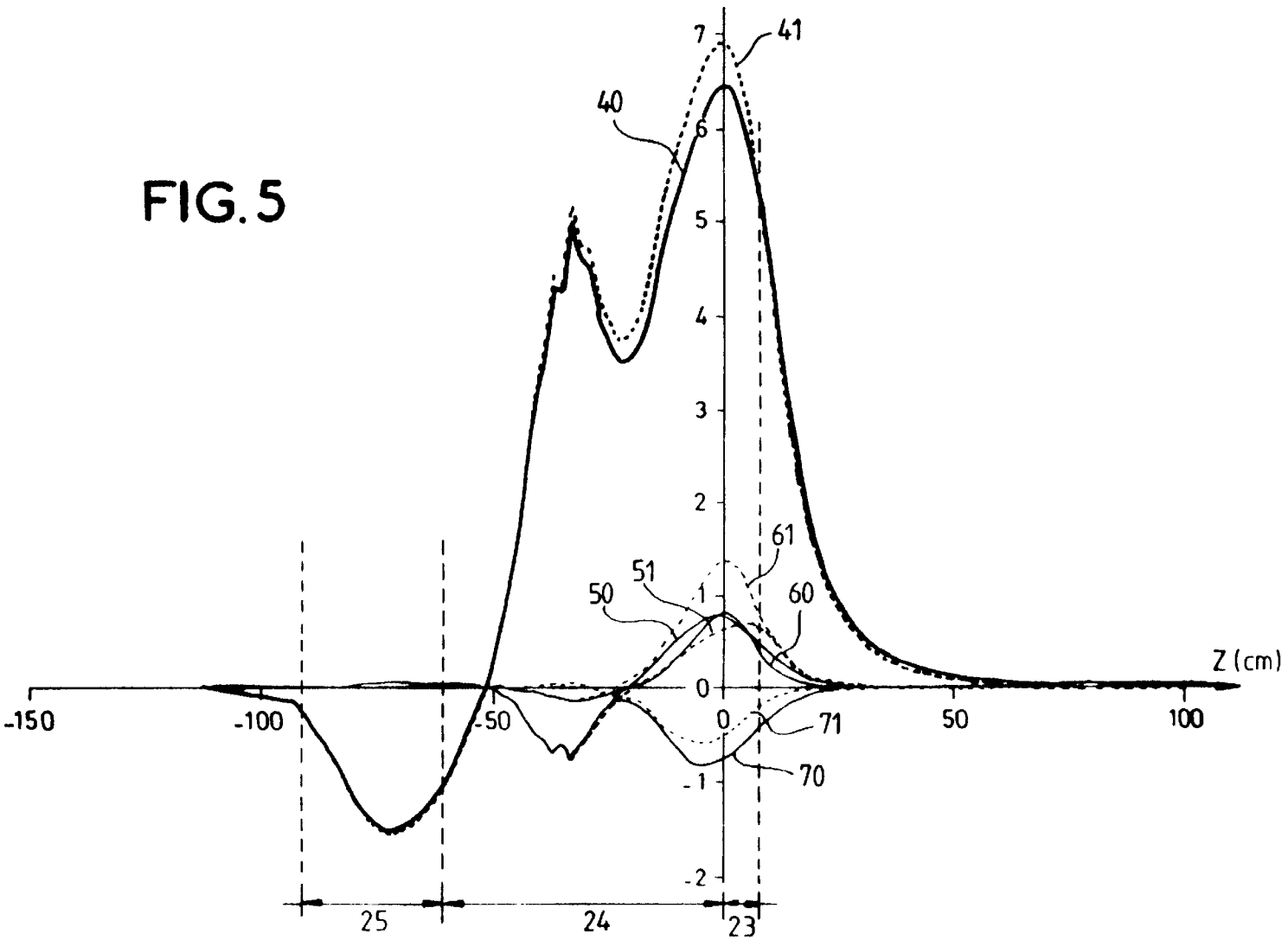
FIG. 5 shows the variation along the main axis Z of the tube of the harmonics of the vertical deflection potential which is generated by a coil according to the invention and the influence of the particular arrangement of the conductors of the lateral harnesses on the said coefficients.

The effect on the vertical magnetic field created by this modification is illustrated in FIG. 5.

In this figure the $3^{rd}$, $5^{th}$, $7^{th}$ and $9^{th}$ harmonics of the vertical deflection potential of the deflection field of the coil according to the prior art are labelled 41, 51, 61 and 71, respectively, and the $3^{rd}$, $5^{th}$, $7^{th}$ and $9^{th}$ harmonics of the vertical deflection coil of the same embodiment of the invention as previously are labelled 40, 50, 60 and 70, respectively. It may be seen that, in the front region of the main window near the region 23, the amplitude of the $7^{th}$-order harmonic, initially greater than the $9^{th}$-order harmonic, has been greatly reduced so as to become of the same order of magnitude, or even substantially less than the said $9^{th}$ harmonic, the said $7^{th}$ and $9^{th}$ harmonics remaining of opposite sign.

Taking other design parameters into account forces certain modifications on the rear part of the main window 18 lying near the transition region between the parts 24 and 25 of the coil. At least for large-sized tubes, experience shows that the radial aperture of the said window 18 in its rear part remains substantially greater than and at least equal to its radial aperture in its front part so as not to compromise the effect obtained on the "vertical blue wave".

Thus, in the embodiment relating to the tube of 97 cm diagonal, the best results were obtained with a radial aperture of the window 18 such that the lateral harness conductors are, to the rear of the coil, near the exit region 23, arranged within an angular aperture of 65°.

What is claimed is:

1. Electromagnetic deflection unit for cathode-ray tubes, comprising:

a pair of horizontal deflection coils; and a pair of vertical deflection coils (4), the vertical deflection coils being in the shape of a saddle, each vertical deflection coil including a front bundle lying on the screen side of the tube and a rear bundle lying on the electron-gun side, the said bundles being connected together by lateral conductor harnesses extending in a direction approximately parallel to the main axis Z of the tube, the front and rear bundles and the lateral harnesses defining a window free of conductors, the window extending in the region close to the front bundle, the window (18) extends over a radial angular aperture Φ of greater than 38°.

2. Electromagnetic deflection unit according to claim 1, wherein the region close to the front bundle, the window extends over a radial angular aperture Φ of between 38° and 50°.

3. Deflection unit according to claim 1, wherein, in the region close to the rear bundle, at least 95% of the lateral harness conductors lie within an angular aperture $\Theta_m$ of less than 80°.

4. Electromagnetic deflection unit for cathode-ray tubes, comprising a pair of horizontal deflection coils; and a pair of vertical deflection coils, the vertical deflection coils being in the shape of a saddle, each vertical deflection coil including a front bundle lying on the screen side of the tube and a rear bundle lying on the electron-gun side, the bundles being connected together by lateral conductor harnesses, the front and rear bundles and the lateral harnesses defining a window free of conductors, wherein in the front region of said window, near the front bundle, the lateral conductor harnesses are arranged such that the $7^{th}$and $9^{th}$order harmonics of the vertical deflection field are of opposite sign and the amplitude of the $7^{th}$ harmonic is approximately equal to or less than the amplitude of the $9^{th}$ harmonic near the front bundle.

* * * * *